US005360674A

United States Patent [19]

Kawai et al.

[11] Patent Number: 5,360,674

[45] Date of Patent: Nov. 1, 1994

[54] PERMANENT MAGNET COATED WITH NI OR NI ALLOY HAVING A SPECIFIC CELL STRUCTURE AND GROWTH PATTERN

[75] Inventors: Hideki Kawai, Kumagaya; Katsuhiko Kojo, Fukaya; Kiyoshi Eguchi; Yoshiko Ogawa, both of Kumagaya, all of Japan

[73] Assignee: Hitachi Metals, Ltd., Tokyo, Japan

[21] Appl. No.: 992,823

[22] Filed: Dec. 16, 1992

[30] Foreign Application Priority Data

Dec. 17, 1991 [JP] Japan ..... 3-353487

[51] Int. Cl.[5] ..... B22F 7/02; B22F 7/04

[52] U.S. Cl. ..... 428/548; 428/552; 427/127

[58] Field of Search ..... 428/546, 551, 548, 553, 428/557, 552, 681; 427/127

[56] References Cited

U.S. PATENT DOCUMENTS 4,837,114 6/1989 Hamada et al. ..... 427/127
4,935,080 1/1990 Hassell et al. ..... 156/154
4,959,273 9/1990 Hamamura et al. ..... 428/548
5,154,987 10/1992 Nakayama et al. ..... 428/469
5,273,782 12/1993 Sagawa et al. .

OTHER PUBLICATIONS

Ken Ohashi et al, "Study of Anticorrosive Treatments of Nd-Fe-B Magnets," Denki Gakkai Magunetikksu Kenkyukui Shiryo vol. MAG-19 No. 250-257 pp. 7-80 Nov. 8, 1991.

*Primary Examiner*—Donald P. Walsh
*Assistant Examiner*—Anthony R. Chi
*Attorney, Agent, or Firm*—Sughrue, Mion, Zinn, Macpeak & Seas

[57] ABSTRACT

A permanent magnet formed by a permanent magnet alloy of R—T—B system chiefly comprising a transition metal T, a rare earth element R including yttrium and boron B, and coated with a protective plating layer of Ni or an Ni alloy, wherein said protective plating layer is 30 μm or less in thickness, and the inter-cell pitch in the surface of said protective plating layer is 14 μm or more.

6 Claims, 4 Drawing Sheets

PERMANENT MAGNET COATED WITH NI OR NI ALLOY HAVING A SPECIFIC CELL STRUCTURE AND GROWTH PATTERN

FIELD OF THE INVENTION

The present invention relates to a permanent magnet formed by a permanent magnet alloy of R—T—B system chiefly comprising a transition metal T whose main component is Fe, a rare earth element R including yttrium and boron B, and coated with a protective plating layer of Ni or an Ni alloy, and more particularly to this permanent magnet with excellent corrosion resistance.

BACKGROUND OF THE INVENTION

The permanent magnet of R—T—B system chiefly comprising Fe has a high performance, so that demand for this magnet has been increasing year after year in the market. However, this magnet has an inherent problem that its corrosion resistance is inferior to that of a permanent magnet of Sm-Co system or a ferrite magnet.

The conventional countermeasure against the above problem is to provide a protective layer by a resin coating by spray or electro-deposition, or vapor plating such as vapor deposition or ion sputtering. Above all, Ni plating is widely used due to its superb corrosion resistance. (Japanese Patent Application Laid-open No.54406).

Nevertheless, the Ni plating film is hard to grow in the grain boundary (Nd-rich phase), because Nd is highly susceptible to oxidation and is rapidly dissolved into the plating bath.

Furthermore, a cell structure appears on the surface of the Ni plating film because fine irregularities exist in the surface of the permanent magnet of R—T—B system, and the Ni plating film does not grow uniformly. The double points and triple points in the boundaries of the cell structure in the surface of this Ni plating film often become start points of corrosion.

The cell boundaries of]the surface of the Ni plating film are formed like a valley or indentations, so that dirt is liable to adhere thereto after the film is formed. The dirt is one of the factors causing corrosion to occur.

SUMMARY OF THE INVENTION

An object of the present invention is to provide a permanent magnet of R—T—B system having superior corrosion resistance.

It has now been found that this object of the invention is attained by a permanent magnet formed by a permanent magnet alloy of R—T—B system chiefly comprising a transition metal T whose main component is re, a rare earth element R including yttrium and boron B, and coated with a protective plating layer of Ni or an N1 alloy, in which said protective plating layer is 30 μm or less in thickness and the inter-cell pitch in the surface of the protective plating layer is 14 μm or more.

The object of the present invention is further achieved by the permanent magnet formed by a permanent magnet alloy of R—T—B system chiefly comprising a transition metal T whose main component is Fe, a rare earth element R including yttrium and boron B, and coated with a protective plating layer of Ni or an Ni alloy, wherein the width of the grow pattern of said protective plating layer is 0.1 μm or more.

In addition, the object of the present invention is attained by the permanent magnet formed by a permanent magnet alloy of R—T—B system chiefly comprising a transition metal T, a rare earth element R Including yttrium and boron B, and coated with a protective plating layer of Ni or an Ni alloy, wherein the X-ray diffraction strength ratio of the (200) face of said protective plating layer is 70% or more.

DETAILED DESCRIPTION OF THE INVENTION

The permanent magnet according to the invention is formed by a permanent magnet alloy of R—T—B system chiefly comprising a transition metal T whose main component is Fe, a rare earth element R including yttrium and boron B, and coated with a protective plating layer of Ni or an Ni alloy, In which the protective plating layer is 30 μm or less and the inter-cell pitch in the surface of the protective plating layer is 14 μm or more.

Figure 1:
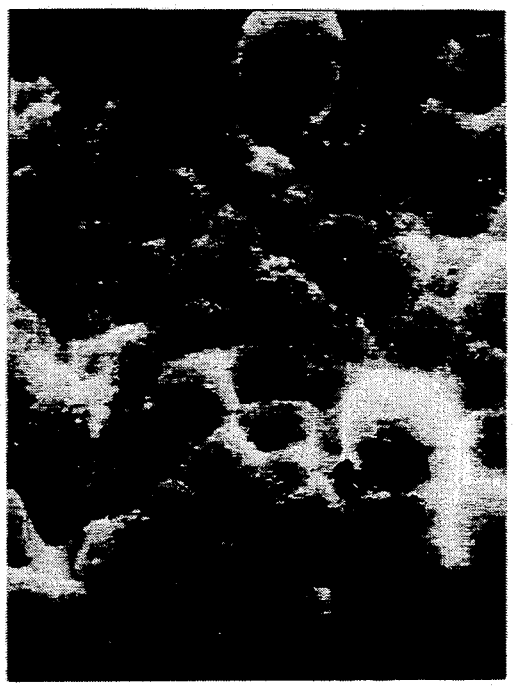
FIG. 1 Is an SEM (scanning electron microscope) photograph (magnification 1,000 times) showing the metallic microstructure of the surface of the protective Ni plating layer of Example 1.

The inter-cell pitch mentioned above is obtained as a mean value of the spaces between the peaks of the projections in the cell structure shown In FIG. 1, e.g., which is an SEM photograph at the magnification of 1,000 times showing a surface of the protective NI plating layer of a permanent magnet.

It is found, as results of various analysis of the corrosion of Ni plating of the permanent magnet, that the cell boundaries of the Ni plating which are susceptible to corrosion occur at the triple points or the like of the grain boundaries and the corrosion expands in the direction perpendicular to the Ni plating surface along the cell boundaries. More specifically, when the corrosion of the surface of the Ni plating progresses in the vertical direction (through-thickness direction) along the cell boundaries and reaches the surface of the permanent magnet, the Nd-rich phase at the grain boundaries highly liable to oxidation is corroded quickly, and owing to the occurrence of the grain boundary elimination, the corrosion of the permanent magnet advances.

In the present invention, when the inter-cell pitch in the surface of the protective plating layer is 14 μm or more, the occurrence of the cell boundaries in the direction perpendicular to the surface of the Ni plating becomes hardly recognizable. On the other hand, when the inter-cell pitch is less than 14 μm, start points of corrosion such as double points or triple points of the cell structure increase, thereby decreasing the corrosion resistance.

To achieve a protective plating layer having substantially no cell structure, it is preferable not to use a gloss Ni plating, as the gloss Ni plating has a large amount of S contents in the protective plating layer resulting in a poor corrosion resistance, and furthermore, the speed of plating film growth is slow.

In the present Invention, the inter-cell pitch of the surface of the protective plating layer can be adjusted by varying the current density, plating bath temperature, bath pH, and the kind and the amount of addition agents.

The permanent magnet of the present invention is further formed by a permanent magnet alloy of R—T—B system chiefly comprising a transition metal T whose main component is Fe, a rare earth element R including yttrium and boron B, and coated with a protective plating layer of Ni or an Ni alloy, wherein the width of the growth pattern of the protective plating layer is 0.1 μm or more.

Figure 3:
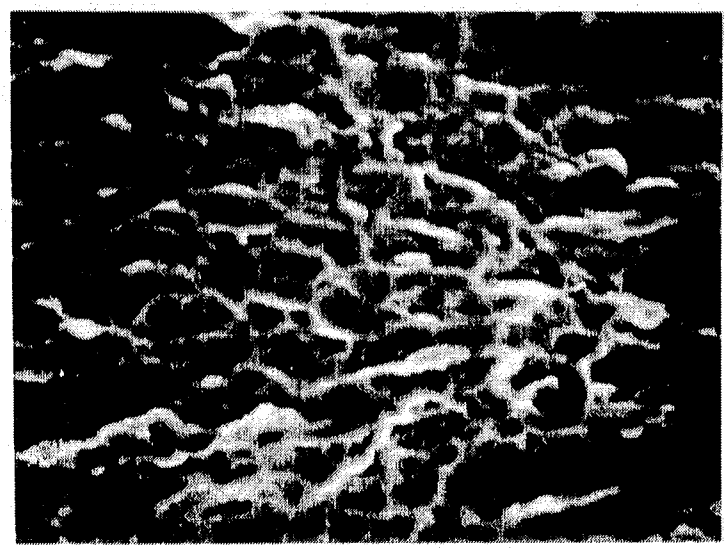
FIG. 3 is an SEM photograph (magnification 20,000 times) showing the growth pattern of the fracture of the protective Ni plating layer.

The growth pattern of the protective plating layer is shown as surrounded by the region (white region) eliminated by etching in FIG. 3, the SEM photograph at the magnification of 20,000 times.

This growth pattern is a fine striped pattern extending substantially in the direction perpendicular to the plating film surface. In each cell structure, this striped pattern can be recognized. The part where the growth patterns in the respective cell structures meet is the cell boundary, and where the double points and the triple points liable to corrosion are formed. The corrosion is considered to progress along the cell boundary. When the width of the growth pattern is much larger than 0.1 μm, the cell boundary is substantially absent in the protective plating layer, so that the corrosion resistance is improved. If the width of the growth pattern is less than 0.1 μm, the growth patterns increase resulting in the generation of the cell boundaries of the protective plating layer, and the cell boundaries become more conspicuous.

In the present invention, the growth pattern of the protective plating layer can be adjusted by varying the current density, plating bath temperature, bath pH, and the kind and the amount of addition agents.

In addition, according to the present invention, the permanent magnet is formed by a permanent magnet alloy of R—T—B system chiefly comprising a transition metal T whose main component is Fe, a rare earth element R including yttrium and boron B, and coated with a protective plating layer of Ni or an Ni alloy, wherein the X-ray diffraction strength ratio of the (200) face of the Ni plating film surface is 70% or more.

The X-ray diffraction strength ratio is a proportion of the diffraction strength of the (200) face to those of three faces, (111), (200) and (220). The diffraction strength of those three faces, (111), (200) and (220) of the permanent magnet surface coated with the protective Ni plating layer are measured by an X-ray diffractometer respectively and the ratio is estimated as follows:

$$\frac{(200)\ \text{strength}}{(111)\ \text{strength} + (200)\ \text{strength} + (200)\ \text{strength}} \times 100$$

When Ni has isotropic orientation, the proportion of the (200) face is normally about 26% as shown in ASTM card No. 4-0850. If the orientation of the (200) face is promoted, the growth patterns are more likely to be arranged in one direction, the difference of angle between the adjacent growth patterns across the cell boundary becomes smaller, and the cell boundary becomes indistinct. Thus, the corrosion along the cell boundary is restrained, that is, the corrosion resistance of the permanent magnet is improved.

The X-ray diffraction strength ratio of the (200) face of the protective plating layer can be adjusted by varying the current density, plating bath temperature, bath pH, and the kind and the amount of addition agents.

The permanent magnet of this invention is a sintered body of a permanent magnet alloy having the particle diameter of 50 μm or less. It is desirable to adjust the particle diameter of the sintered body to be 50 μm or less. When the particle diameter of the sintered body exceeds 50 μm, a large cell structure appears in the protective plating layer after the fashion of the sintered body, and the double points and triple points of the cell structure having wide steps possibly provide corrosion.

The chemical composition of the alloy of R—T—B system in this invention is well known (Japanese Patent Application laid-open No.61-34242), and additional elements, if added as the occasion demands, having influence on the present invention. The plating method of Ni in the present invention may be either electroplating or electroless plating.

The invention is now illustrated in greater detail with reference to the following specific examples and embodiments, but the present invention is not to be construed as limited thereto.

EXAMPLE 1

An ingot with a composition of 14Nd-1Dy-7B-78Fe in atomic percent was obtained by casting. This ingot was pulverized by a stamping mill and processed by a ball mill to obtain alloy powder of an average particle diameter of 3.5 μm. This alloy powder was molded under 1.5 ton/cm$^2$ in a magnetic field of 12 kOe and a molded body was obtained.

This molded body was heated for one hour at 1,100° C. in an argon atmosphere, and quenched to obtain a sintered body. The sintered body was subjected to an aging process for two hours at 600° C. in an argon atmosphere, whereby a permanent magnet was produced. From this permanent magnet, a piece of magnet measuring 10 mm×10 mm×20 mm was cut out to obtain a permanent magnet body.

This permanent magnet body was coated with an Ni plating film by an electroplating process. For this Ni plating, a watt bath was used at a temperature of 45° C. and bath pH 4 varying the current density, whereby a permanent magnet specimens were obtained which have various inter-cell pitches provided in the plating film surface. This protective layer was formed by varying the plating time to have a layer thickness of 15 to 20 μm. The inter-cell pitch was obtained by observing the permanent magnet surface under a laser microscope and counting the number of cells included in a length of 100 μm.

Figure 6:
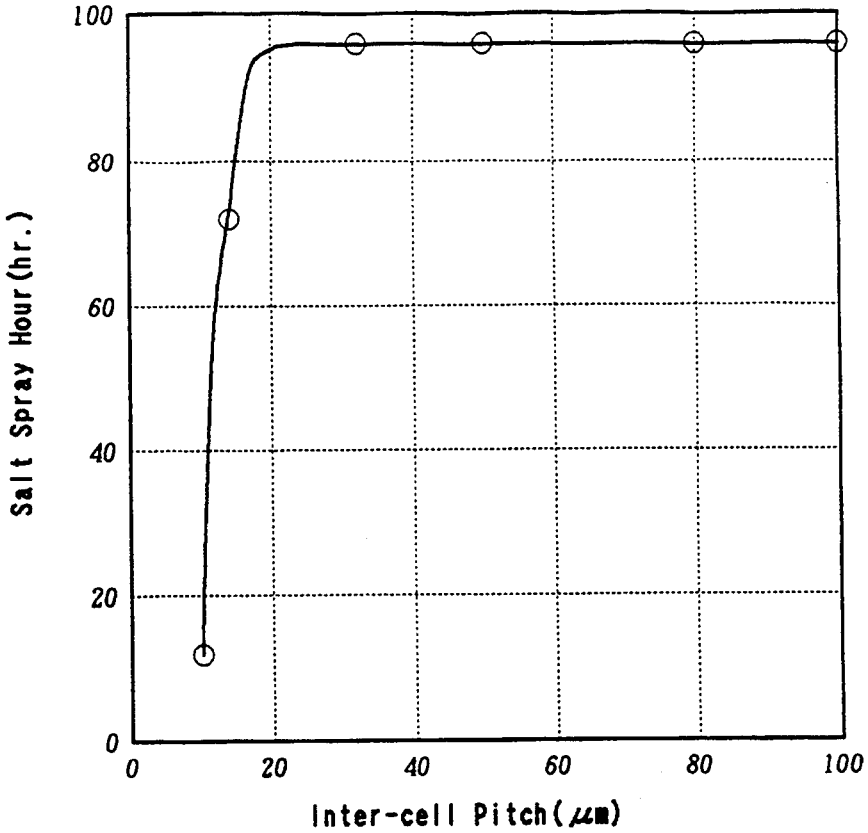
FIG. 6 is a diagram showing the relationship between the inter-cell pitch and the numbers of hours before rusting in salt spray test in Example 1.

The test specimens underwent PCT test (pressure cooker test at 120° C., 2 atm.) and salt spray test (35° C., 5% NaCl). The tested specimens were assessed by visual observation. The results are shown in Table 1 and FIG. 6. In Table 1, the numbers of hours are the elapsed times until rusting was first recognized, and Sample Nos:. 1 to 5 are the examples of the present invention and Sample No. 6 is the comparative example. In FIG. 6, the salt spray hours on the axis of ordinates are the elapsed times until rusting was first recognized.

TABLE 1

| | Inter-cell Pitch (μm) | PCT (hr.) | Salt Spray Test (hr.) | Presence Density of Triple Points (No.) |
|---|---|---|---|---|
| 1 | more than 100 | more than 120 | 96 | 0 |
| 2 | 80 | more than 120 | 96 | — |
| 3 | 50 | more than 120 | 96 | — |
| 4 | 32 | more than 120 | 96 | — |
| 5 | 14 | more than 120 | 72 | — |
| 6 | 10 | 48 | 12 | more than 100 |

From Table 1 and FIG. 6, it is evident that a permanent magnet of R—T—B system in which the inter-cell pitch of the protective plating layer surface is 14 μm or more has a superior corrosion resistance both in PCT test and salt spray test compared with a permanent magnet with inter-cell pitch of the protective plating layer surface less than 14 μm. The comparative example could not meet the generally required condition of 24 hours or more in salt spray test.

Figure 2:
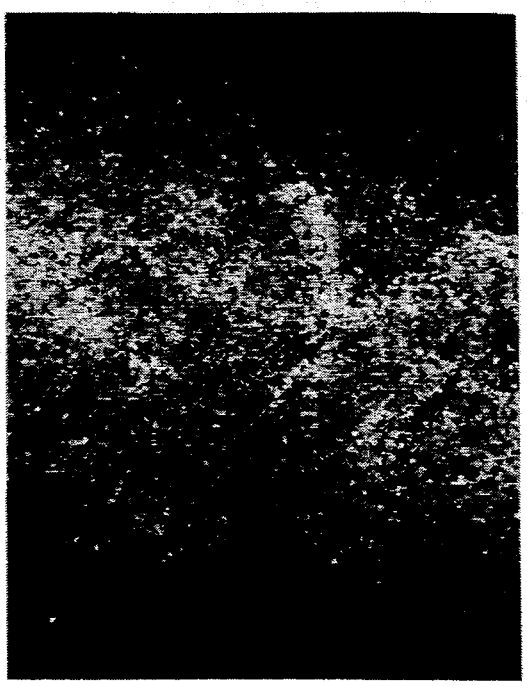
FIG. 2 Is an SEM photograph (magnification 1,000 times) showing the metallic microstructure of the surface of the protective Ni plating layer of Example 1.

FIG. 1 is an SEM photograph of Sample No. 6 and FIG. 2, an SEM photograph of Sample No. 1. The magnification is 1,000 times respectively. As is apparent by comparison of FIG. 1 and FIG. 2, the specimen with a larger inter-cell pitch shown in FIG. 2 has a decreased presence density of double points and triple points of the cell boundary which become the start points of corrosion of the protective plating layer surface. The presence density of triple points at the cell boundary was observed in a range of 100μm×100 μm of an SEM photograph.

EXAMPLE 2

The permanent magnet bodies obtained in the same manner as in EXAMPLE 1 were coated with a plating film of Ni by electroplating. For this Ni plating, a watt bath was used at a temperature of 45° C. and bath pH 4, and by varying the current density, permanent magnet specimens with different ratios of X-ray diffraction strength of the (200) face were obtained. The protective layer was provided with a layer thickness of 15 to 20 μm by varying the plating time.

Figure 7:
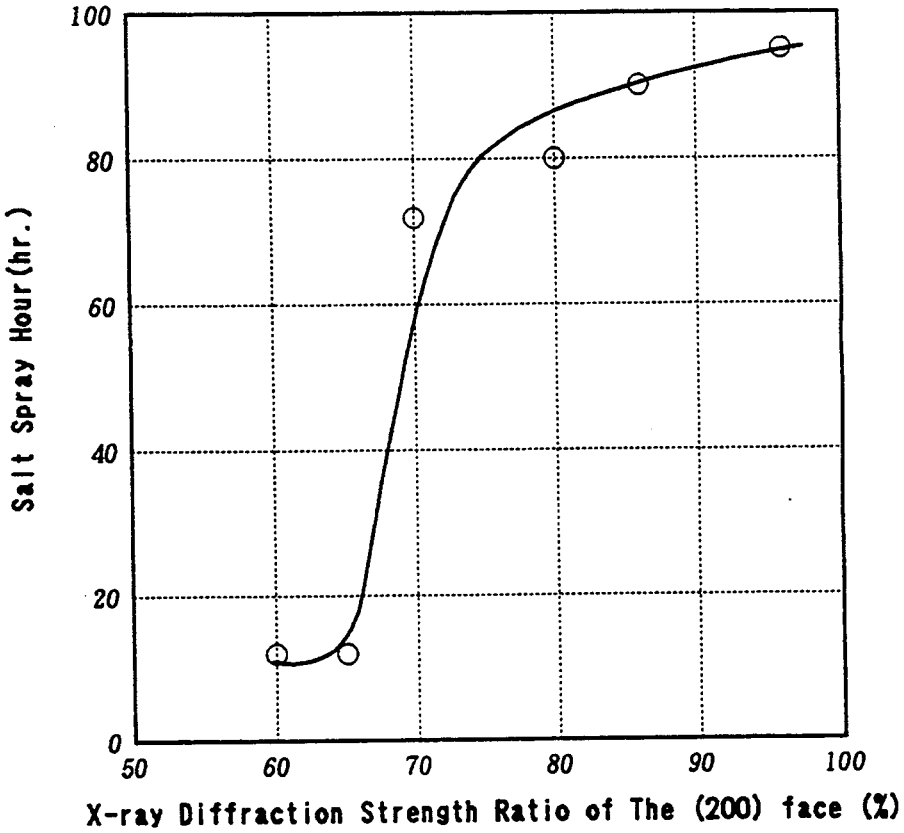
FIG. 7 is a diagram showing the relationship between the X-ray diffraction strength ratio in the (200) face and the numbers of hours before rusting in salt spray test in Example 2.

The diffraction strength of this plating film surface was measured by an X-ray diffractometer. The X-ray diffraction strength measurement was carried out using a Co target and with a Co-Kα ray under the condition of a tube voltage of 40 kV and a current of 120 mA. The test specimens underwent PCT test (120° C., 2 atm.) and salt spray test (35° C., 5% NaCl). After the tests, the specimens were assessed by visual observation. The results are shown in Table 2 and FIG. 7. In Table 2, the numbers of hours are the elapsed times until rusting was first recognized and Sample Nos. 1 to 4 are the examples of the present Invention and Sample Nos. 5 and 6 are the comparative examples. In FIG. 7, the salt spray hours on the axis of ordinates are the elapsed times until rusting was first recognized.

TABLE 2

| | X-ray Diffraction Strength Ratio (%) | PCT (hr.) | Salt Spray Test (hr.) |
|---|---|---|---|
| 1 | 96 | more than 120 | 95 |
| 2 | 86 | more than 120 | 90 |
| 3 | 80 | more than 120 | 80 |
| 4 | 70 | more than 120 | 72 |
| 5 | 65 | 72 | 12 |
| 6 | 60 | 48 | 12 |

As shown in Table 2 and FIG. 7, permanent magnets of R—T—B system with the X-ray diffraction strength ratio of 70% or more at the (200) face of the protective layer surface exhibit superior corrosion: resistance in both PCT test and salt spray test. The comparative examples could not meet the generally required condition of 24 hours or more in salt spray test.

EXAMPLE 3

The permanent magnet bodies obtained in the same manner as in EXAMPLE 1 were coated with an Ni plating film by electroplating. For this protective plating layer, a watt bath was used at a temperature of 45° C. and bath $pH_4$, and by varying the current density, permanent magnet specimens having growth patterns of different widths in the protective plating layer were obtained. The growth patterns appear when the permanent magnet specimen is cut, the fracture is ground, and then dry-etched by ion milling. The Ni plating has a layer thickness of 15 to 20 μm.

The specimens underwent PCT test (120° C., 2 atm.) and salt spray test (35° C., 5% NaCl). After the tests, the specimens were assessed by visual observation. The test results are shown in Table 3. The numbers of hours in Table 3 are the elapsed times until rusting was first recognized. Sample Nos. 1 and 2 are the examples of the present invention and Sample Nos. 3 and 4 are the comparative examples.

TABLE 3

| | Growth Pattern Width (μm) | PCT (hr.) | Salt Spray Test (hr.) |
|---|---|---|---|
| 1 | 0.4 | more than 120 | 120 |
| 2 | 0.1 | 96 | 24 |
| 3 | 0.06 | 48 | less than 24 |
| 4 | 0.03 | 48 | less than 24 |

From Table 3, it is obvious that permanent magnets of R—T—B system with the growth pattern width of 0.1 μm or more in the protective plating layer have superior corrosion resistance both in PCT test and salt spray test compared with the permanent magnets with the growth pattern width of less than 0.1 μm.

Figure 4:
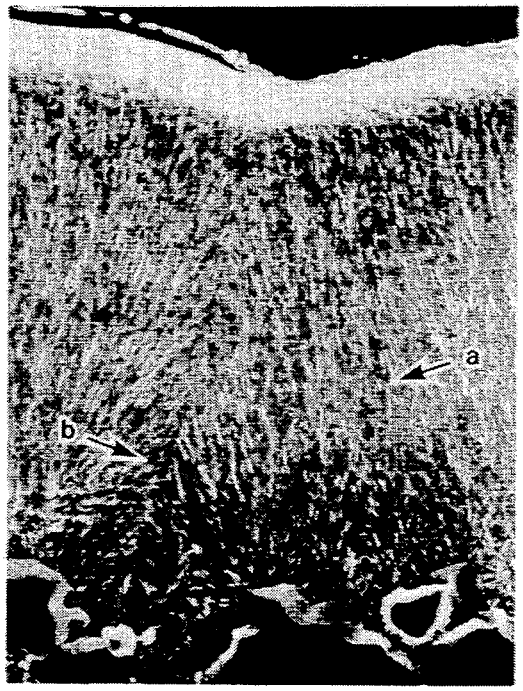
FIG. 4 is an SEM photograph (magnification 3,000 times) showing the metallic microstructure of the fracture of the protective Ni plating layer.

FIG. 4 is an SEM photograph showing the metallic microstructure of the fracture of the protective Ni plating layer having the growth pattern width less than 0.1 μm (indicated by the arrow a) and the cell boundary (indicated by the arrow b) In FIG. 4, the rugged dark region at the lower side is the sintered body of the NdFeB magnet, and the upper layer is the Ni plating layer. The magnification is 3,000 times. As shown In FIG. 4, when the growth pattern is less than 0.1 μm, the growth patterns increase resulting in the generation of the cell boundaries of the protective plating layer of Ni, and the cell boundaries become more conspicuous.

Figure 5:
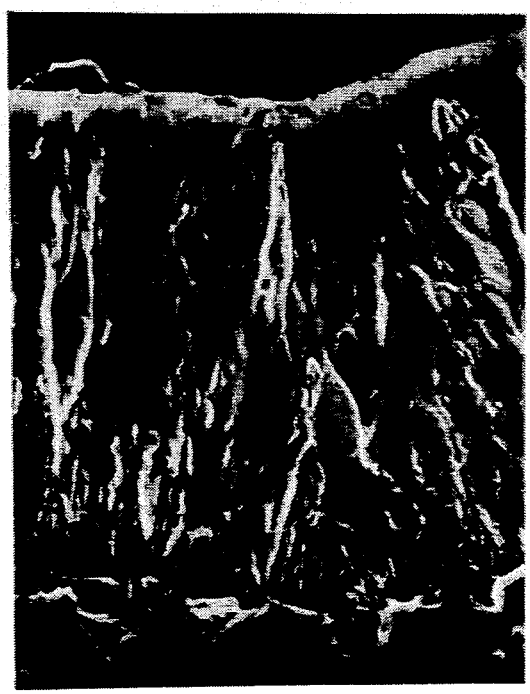
FIG. 5 is an SEM photograph (magnification 3,000 times) showing the metallic microstructure of the fracture of the protective Ni plating layer.

FIG. 5 is an SEM photograph showing the microstructure of the fracture of the protective Ni plating layer having the growth pattern width much larger than 0.1 μm, the cell boundary is substantially absent In the protective plating layer, so that the corrosion resistance is improved.

EXAMPLE 4

The permanent magnet bodies obtained in the same manner as In Example 1 except varying the particle diameter of the sintered bodies of the permanent magnet are coated with an Ni plating film by electroplating. For the protective plating layer, a watt bath was used at a bath temperature of 45° C., a bath pH 4 and a current density of 3A/dm$^2$. The Ni plating is 15 to 20 μm in layer thickness.

The specimens underwent PCT test (120° C., 2 atm.) and salt spray test (35° C., 5% NaCl). The specimens were assessed by visual observation. The test results are shown in Table 4. The numbers of hours in Table 4 are the elapsed times until rusting was first recognized. Sample Nos. 1 and 2 are the examples of the present invention and Sample Nos. 3 and 4 are the comparative examples.

TABLE 4

| | Particle Dia. of Sintered Body (μm) | PCT (hr.) | Salt Spray Test (hr.) |
|---|---|---|---|
| 1 | 20 | more than 120 | 120 |
| 2 | 50 | 96 | 24 |
| 3 | 60 | 48 | less than 24 |
| 4 | 80 | 48 | less than 24 |

As shown in Table 4, the permanent magnets of R—T—B system having the sintered body with particle diameter of 50 μm or less exhibit superior corrosion resistance both in PCT test and salt spray test Compared with the permanent magnets having the sintered body with the particle diameter of 50 μm or more.

As demonstrated by the above results, the permanent magnet of R—T—B system according to the present invention exhibit an excellent corrosion resistance and provide wide application.

While the invention has been described in detail and with reference to specific embodiments thereof, it will be apparent to one skilled in the art that various changes and modifications can be made therein without departing from the spirit and scope thereof.

What is claimed is:

1. A permanent magnet formed by a permanent magnet alloy of R—T—B system chiefly comprising a transition metal T, a rare earth element R including yttrium and boron B, and coated with a protective plating layer of Ni or an Ni alloy, wherein said protective plating layer is 30 μm or less in thickness, and the inter-cell pitch at the surface of said protective plating layer obtained as a mean value of the spaces between peaks of projections of the cell structure is 14 μm or more.

2. A permanent magnet formed by a permanent magnet alloy of R—T—B system chiefly comprising a transition metal T, a rare earth element R including yttrium and boron B, and coated with a protective plating layer of Ni or an Ni alloy, wherein the width of the growth pattern of said protective plating layer is 0.1 μm or more.

3. A permanent magnet formed by a permanent magnet alloy of R—T—B system chiefly comprising a transition metal T, a rare earth element R including yttrium and boron B, and coated with a protective plating layer of Ni or an Ni alloy, wherein the X-ray diffraction strength ratio of the (200) face to those of the (111), (200) and (220) faces of said protective plating layer is 70% or more.

4. The permanent magnet according to claim 1, wherein said permanent magnet is a sintered body having the particle diameter of 50 μm or less.

5. The permanent magnet according to claim 2, wherein said permanent magnet is a sintered body having the particle diameter of 50 μm or less.

6. The permanent magnet according to claim 3, wherein said permanent magnet is a sintered body having the particle diameter of 50 μm or less.

* * * * *